US010240475B2

(12) United States Patent
Clouse

(10) Patent No.: US 10,240,475 B2
(45) Date of Patent: Mar. 26, 2019

(54) HEAT SHIELDS FOR AIR SEALS

(71) Applicant: United Technologies Corporation, Farmington, CT (US)

(72) Inventor: Brian Ellis Clouse, Saugus, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 389 days.

(21) Appl. No.: 15/101,067

(22) PCT Filed: Nov. 11, 2014

(86) PCT No.: PCT/US2014/064940
§ 371 (c)(1),
(2) Date: Jun. 2, 2016

(87) PCT Pub. No.: WO2015/084550
PCT Pub. Date: Jun. 11, 2015

(65) Prior Publication Data
US 2016/0305267 A1 Oct. 20, 2016

Related U.S. Application Data

(60) Provisional application No. 61/911,328, filed on Dec. 3, 2013.

(51) Int. Cl.
*F01D 11/08* (2006.01)
*F01D 11/12* (2006.01)
*F01D 25/24* (2006.01)

(52) U.S. Cl.
CPC ..... *F01D 11/08* (2013.01); *F01D 11/127* (2013.01); *F01D 25/24* (2013.01); *F01D 25/246* (2013.01);
(Continued)

(58) Field of Classification Search
CPC ..... F01D 11/127; F01D 25/246
See application file for complete search history.

(56) References Cited

U.S. PATENT DOCUMENTS 4,242,042 A * 12/1980 Schwarz ..... F01D 11/24 415/116
4,925,365 A * 5/1990 Crozet ..... F01D 9/04 277/415

(Continued)

FOREIGN PATENT DOCUMENTS

DE 10122464 C1 3/2002
EP 1231420 A2 8/2002

OTHER PUBLICATIONS

European Search Report, European Application No. 14868571.2, dated Sep. 15, 2017, European Patent Office; European Search Report 7 pages.
Notification of Transmittal of the International Search Report of the International Searching Authority, or the Declaration; PCT/US2014/064940; dated Feb. 24, 2015. 3 pages.

(Continued)

*Primary Examiner* — Woody A Lee, Jr.
(74) *Attorney, Agent, or Firm* — Cantor Colburn LLP

(57) ABSTRACT

An outer air seal includes a seal wall, a heat shield, a side wall and a blade seal disposed radially inward of the seal wall. The seal wall has axially opposed first and second ends. The heat shield is radially outward of the seal wall and has first and second ends axially opposed ends. The second end of the heat shield is joined to the second end of the seal wall. The side wall is between the seal wall and the heat shield and spaces the first ends of the heat shield and the seal wall apart to form an inner cavity therebetween. Inner and outer diameter ends of the side wall are joined to the first ends of the seal wall and of the heat shield, respectively. The heat shield is configured to thermally isolate an outer case from the inner cavity and the seal wall.

18 Claims, 2 Drawing Sheets

(52) U.S. Cl.
CPC .... *F05D 2220/32* (2013.01); *F05D 2230/237* (2013.01); *F05D 2240/11* (2013.01); *F05D 2260/231* (2013.01); *F05D 2260/941* (2013.01)

(56) References Cited

U.S. PATENT DOCUMENTS

| | | | | |
|---|---|---|---|---|
| 5,779,436 | A | 7/1998 | Glezer et al. | |
| 6,652,226 | B2 * | 11/2003 | Albrecht, Jr. | F01D 5/225 415/173.4 |
| 8,439,636 | B1 * | 5/2013 | Liang | F01D 25/246 415/173.1 |
| 9,109,458 | B2 * | 8/2015 | Alvanos | F01D 11/001 |
| 9,506,367 | B2 * | 11/2016 | Clouse | F01D 25/246 |
| 9,605,551 | B2 * | 3/2017 | Feldmann | F01D 11/127 |
| 2004/0213666 | A1 * | 10/2004 | Gieg | F01D 11/127 415/170.1 |
| 2006/0216146 | A1 * | 9/2006 | Thompson | F01D 11/08 415/213.1 |
| 2008/0075584 | A1 | 3/2008 | Philippot | |
| 2010/0047062 | A1 | 2/2010 | Khanin et al. | |
| 2011/0236188 | A1 | 9/2011 | Knapp et al. | |
| 2013/0051972 | A1 | 2/2013 | Romanov | |
| 2014/0044529 | A1 * | 2/2014 | Feldmann | F01D 9/04 415/173.1 |

OTHER PUBLICATIONS

Notification of Transmittal of the Written Opinion of the International Searching Authority, or the Declaration; PCT/US2014/064940; dated Feb. 24, 2015. 4 pages.

* cited by examiner

HEAT SHIELDS FOR AIR SEALS

RELATED APPLICATIONS

This application claims the benefit of and priority to U.S. Provisional Patent Application No. 61/911,328 filed Dec. 3, 2013, the contents of which are incorporated herein by reference in their entirety.

BACKGROUND OF THE INVENTION

1. Field of the Invention

The present disclosure relates to air seals, and more particularly to heat shields for turbine blade outer air seals in gas turbine engines, for example.

2. Description of Related Art

Traditionally, a gas turbine engine includes a turbine with multiple blades, impelled by combustion gases, which in turn drive a compressor. Due to the very high temperatures of the gases in the turbine engine, it is typical to protect turbine components from these high temperatures, either by cooling, shielding, or the like.

For the turbine to operate efficiently, the combustion gases must impart energy into the blades and must be substantially prevented from leaking axially around the tips of the blades. A blade outer air seal between the tips of the blades and the static structure, e.g. a case, can be used to reduce this leaking. Heat shields can be disposed over non-gaspath portions of the blade outer air seals to limit heat transfer into the case.

Such conventional methods and systems have generally been considered satisfactory for their intended purpose. However, there is still a need in the art for improved outer air seals and heat shields for gas turbine engines.

SUMMARY OF THE INVENTION

An outer air seal includes a seal wall, a heat shield, a side wall and a blade seal. The seal wall has a first end and an axially opposed second end. The heat shield is radially outward of the seal wall. The heat shield also has a first end and an axially opposed second end. The second end of the heat shield is joined to the second end of the seal wall. The side wall is disposed between the seal wall and the heat shield. The side wall spaces the first end of the heat shield and the first end of the seal wall apart to form an inner cavity between the seal wall and the heat shield. An inner diameter end of the side wall is joined to the first end of the seal wall and an outer diameter end of the side wall is joined to the first end of the heat shield. The heat shield is configured to thermally isolate an outer case from the inner cavity and the seal wall. The blade seal is disposed radially inward of the seal wall.

In accordance with certain embodiments, the heat shield can include a bend configured to accommodate axial thermal expansion and contraction. An inner diameter surface of the heat shield proximate to the second end of the heat shield can be brazed to an outer diameter surface of the seal wall proximate to the second end of the seal wall. An inner diameter surface of the heat shield proximate to the first end of the heat shield can brazed to the outer diameter side of the side wall. An outer diameter surface of the seal wall proximate to the first end of the seal wall can be brazed to the inner diameter side of the side wall.

It is also contemplated that the outer air seal can include braze joints between the second ends of the heat shield and the seal wall, between the first end of the heat shield and the side wall, and between the first end of the seal wall and the side wall. The braze joints can be configured to add circumferential stiffness to the blade seal helping to maintain the circular shape of the blade seal to control the clearance between a blade tip and the blade seal.

A turbine blade outer air sealing system for a gas turbine engine includes a cylindrical outer case and a seal assembly. The cylindrical outer case has a forward end and an aft end. The seal assembly is radially inward of the cylindrical outer case. The seal assembly includes a plurality of outer air seals, as described above, arranged end to end circumferentially to form a cylinder.

The sealing system can also include a plurality of shiplaps disposed radially outward of the heat shields. A respective gap can separate each adjacent end of the outer air seals. Each respective shiplap is operatively connected to the adjacent ends of respective outer air seals proximate the respective gap. Each respective shiplap is configured to block air flow in the radial direction around a radial edge of the heat shield from flowing through the respective gap.

Each shiplap can include a bend configured to accommodate axial thermal expansion and contraction. An inner diameter surface of the shiplap can be brazed onto an outer diameter surface of the heat shield.

The sealing system can also include a plurality of turbine blades disposed radially inward of the seal assembly. The blade seal of each outer air seal can be configured to reduce axial fluid leakage at the turbine blade tips.

These and other features of the systems and methods of the subject disclosure will become more readily apparent to those skilled in the art from the following detailed description of the embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
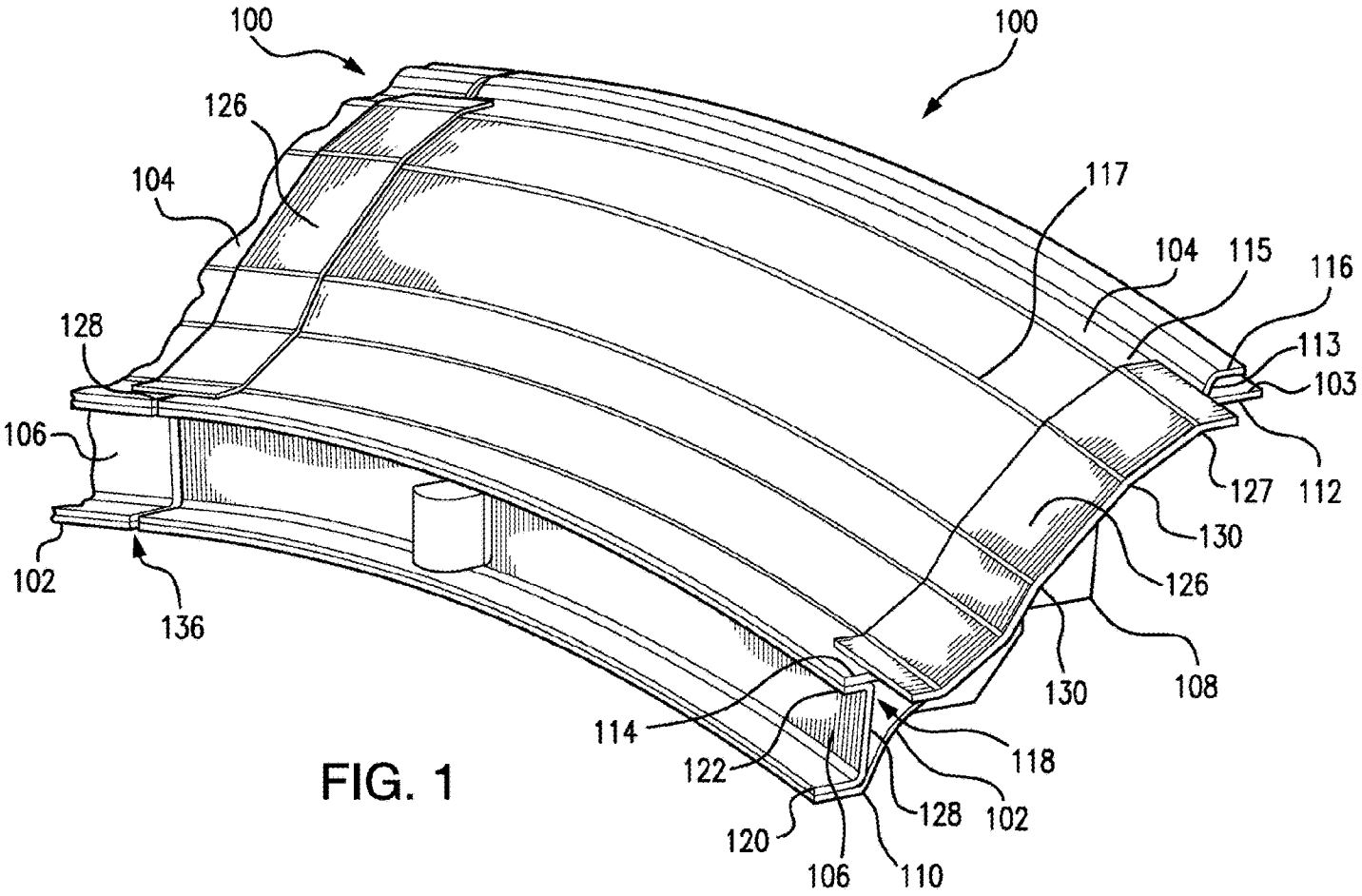
FIG. 1 is a perspective view of an exemplary embodiment of an outer air seal constructed in accordance with the present disclosure, showing the heat shield and shiplap.

Reference will now be made to the drawings wherein like reference numerals identify similar structural features or aspects of the subject disclosure. For purposes of explanation and illustration, and not limitation, a cross-sectional view of an exemplary embodiment of an outer air seal in accordance with the disclosure are shown in FIG. 1 and is designated generally by reference character 100. Other embodiments of outer air seals for gas turbine engines in accordance with the disclosure, or aspects thereof, are provided in FIG. 2, as will be described.

FIG. 1 shows one outer air seal 100 with a partial portion of a second outer air seal 100 at the upper left. As shown in FIG. 1, outer air seals 100 each include a seal wall 102, a heat shield 104, a side wall 106 and a blade seal 108. Blade seal 108 is disposed radially inward of seal wall 102. Seal wall 102 has a first end 110 and an axially opposed second end 112. Heat shield 104 is radially outward of seal wall 102. Heat shield 104 also has a first end 114 and an axially opposed second end 116.

As shown in FIG. 1, outer air seals 100 include shiplaps 126 disposed radially outward of heat shields 104. Shiplaps 126 include a plurality of bends 130 configured to allow for axial thermal expansion and contraction. An inner diameter surface 127 of each shiplap 126 is brazed onto an outer diameter surface 115 of heat shield 104. Those skilled in the art will readily appreciate that the portion of inner diameter surface 127 proximate to outer diameter surface 115 can be brazed in its entirety to outer diameter surface 115. Those skilled in the art will readily appreciate that shiplaps 126 can be brazed in a variety of places along outer diameter surface 115. Further, it will also be appreciated that shiplaps 126 can also be brazed on an inner diameter surface 113 of heat shield 104. A respective gap 136 separates each adjacent end of outer air seals 100. Each respective shiplap 126 is operatively connected to the adjacent ends of respective outer air seals 100 proximate respective gap 136. Each respective shiplap 126 is configured to block flow in the radial direction around an edge 128 of heat shield 104 from flowing through respective gap 136.

Figure 2:
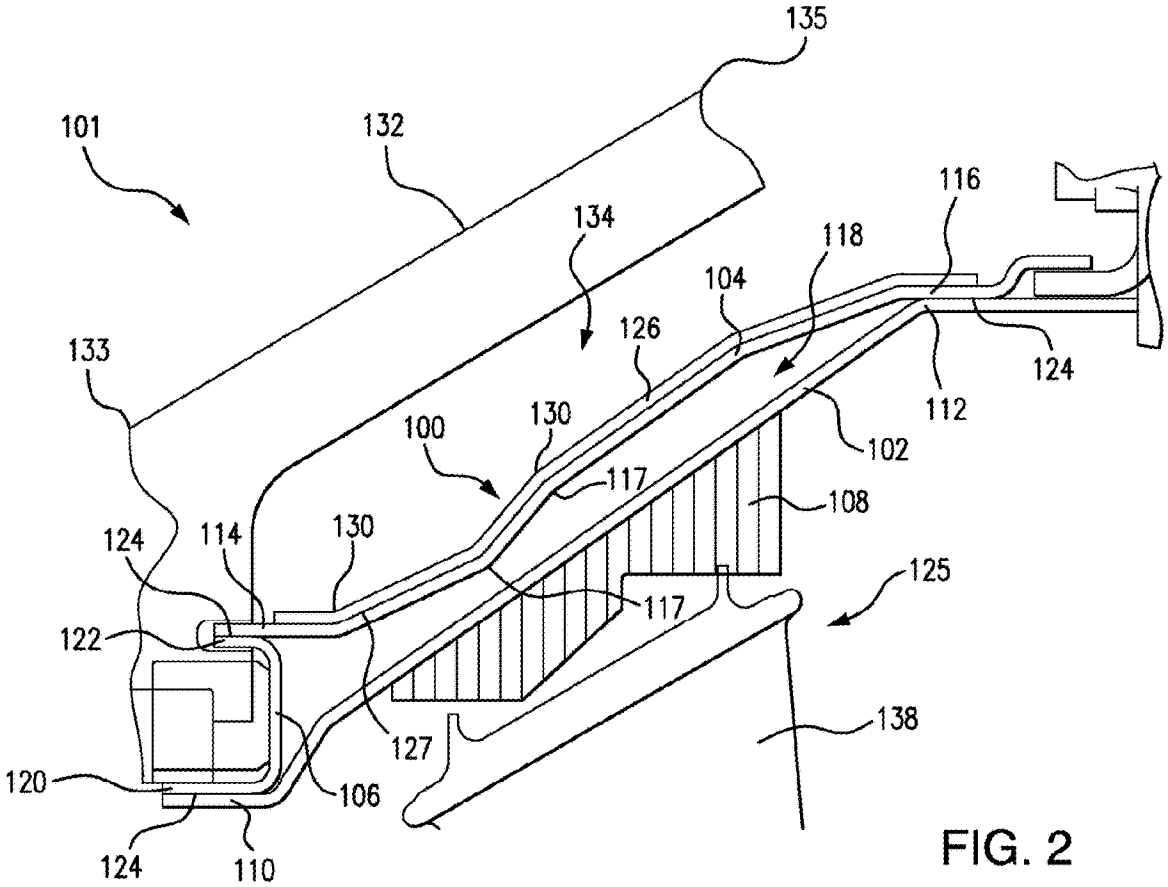
FIG. 2 is a cross-sectional side elevation view of the outer air sealing system of FIG. 1, showing the outer air seal, the turbine blade and the outer case.

As shown in FIGS. 1 and 2, inner diameter surface 113 of heat shield 104 proximate to second end 116 of heat shield 104 is brazed to an outer diameter surface 103 of seal wall 102 proximate to second end 112 of seal wall 102 at a braze joint 124. Side wall 106 is disposed between seal wall 102 and heat shield 104. Side wall 106 spaces first end 114 of heat shield 104 and first end 110 of seal wall 102 apart to form an inner cavity 118 between seal wall 102 and heat shield 104. An inner diameter end 120 of side wall 106 is brazed to an outer diameter surface 103 of seal wall 102 proximate to first end 110 at another braze joint 124 and an outer diameter end 122 of side wall 106 is brazed to an inner diameter surface 113 of heat shield 104 proximate to first end 114 at another braze joint 124. Braze joints 124 are configured to add circumferential stiffness to blade seal 108, helping to maintain the circular shape of blade seal 108 to control the clearance between a turbine blade tip 125 and blade seal 108.

Those skilled in the art will readily appreciate that the increased circumferential stiffness can also permit outer air seals 100 to withstand greater panel-type vibration modes than traditional outer air seals, resulting in reduced fatigue loading. Panel-type vibration modes are natural vibration modes found in wide, thin structures, such as heat shield 104, side wall 106 and/or blade seal 108. Repeated flexing of these structures, such as flexing caused by excitation of vibration modes, can eventually cause cracking from metal fatigue. Those skilled in the art will readily appreciate that the increased circumferential stiffness reduces the amount of deflection that can occur when a natural vibration mode is excited, reducing the possibility of a fatigue failure, and increases the frequencies of these modes, reducing the likelihood of their being excited at all in operation.

Now with reference to FIG. 2, a turbine blade outer air sealing system 101 for a gas turbine engine includes a cylindrical outer case 132 and a seal assembly 134. Cylindrical outer case 132 has a forward end 133 and an aft end 135. Seal assembly 134 is radially inward of cylindrical outer case 132. Seal assembly 134 includes a plurality of outer air seals 100, arranged end to end circumferentially to form a cylinder. Sealing system 101 also includes a plurality of turbine blades 138 disposed radially inward of seal assembly 134. Blade seal 108 of each outer air seal 100 is configured to reduce axial fluid leakage at turbine blade tips 125.

As shown in FIGS. 1 and 2, heat shield 104 and shiplaps 126 include a plurality of bends 117 and 130, respectively, configured to allow for axial thermal expansion and contraction, for example, allowing them to be stretched axially by the hotter seal wall 102, without causing substantial deformation of their shape, even though heat shield 104 is brazed to seal wall 102 at heat shield 104 first and second ends, 114 and 116, respectively. Heat shield 104 is configured to thermally isolate outer case 132 from inner cavity 118 and seal wall 102, substantially limiting the ability of fluid, e.g. hot air, from inside inner cavity 118 from flowing out onto outer case 132. Those skilled in the art will readily appreciate that the limitation of fluid flow from inner cavity 118 can be of increased importance if the pressure on outer case 132 side of outer air seal 100 is greater than the pressure on blade 138 side of outer air seal 100. This difference in pressure tends to cause additional hot fluid to seep from inner cavity 118, through any gaps or unsealed surfaces, and convectively heat outer case 132.

Those skilled in the art will readily appreciate that the reduced heat flux into outer case 132 side of outer air seal 100 can increase the life of engine components on outer case 132 side of outer air seal 100, or can provide opportunities for costs savings by using lower-cost material with a lower temperature capability for components located on outer case 132 side of outer air seal 100. Those skilled in the art will also readily appreciate that outer air seal 100 tends to require a reduced number of seal components as compared with traditional outer air seals. This can reduce error, and simplify manufacturing of the outer air seals.

While exemplary embodiments of outer air seals 100 are described herein as having seal walls 102, side walls 106, heat shields 104 and shiplaps 126 brazed to one another at respective joints, those skilled in the art will readily appreciate that there are a variety of suitable joining techniques that can be used to join the components described above, such as welding, casting, integral forming, additive methods, and the like.

The systems, devices and methods of the present disclosure, as described above and shown in the drawings, provide for heat shields on outer air seals with superior properties including improved convective heat shielding and potential for simplification of manufacture and assembly. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. A blade outer air seal for a turbomachine, comprising:

a seal wall with a first end and a second end axially opposing the first end;

a heat shield radially outward of the seal wall with a first end and a second end axially opposing the first end, wherein the second end of the heat shield is joined to the second end of the seal wall;

a side wall disposed between the seal wall and the heat shield spacing the first end of the heat shield and the first end of the seal wall apart to form an inner cavity between the seal wall and the heat shield, wherein an inner diameter end of the side wall is joined to the first end of the seal wall and an outer diameter end of the side wall is joined to the first end of the heat shield, wherein the heat shield is configured to thermally isolate an outer case from the inner cavity and the seal wall;

a blade seal disposed radially inward of the seal wall; and a shiplap disposed radially outward of the heat shield configured to block air flow in the radial direction around an edge of the heat shield.

2. An outer air seal as recited in claim 1, wherein the heat shield includes a bend configured to accommodate axial thermal expansion and contraction.

3. An outer air seal as recited in claim 1, further comprising braze joints between the second ends of the heat shield and the seal wall, between the first end of the heat shield and the side wall, and between the first end of the seal wall and the side wall, wherein the braze joints are configured to add circumferential stiffness to the blade seal helping to maintain the circular shape of the blade seal to control the clearance between a turbine blade tip and the blade seal.

4. An outer air seal as recited in claim 1, wherein the shiplap includes a bend configured to allow for axial thermal expansion and contraction.

5. An outer air seal as recited in claim 1, wherein an inner diameter surface of the shiplap is brazed onto an outer diameter surface of the heat shield.

6. An outer air seal as recited in claim 1, wherein an inner diameter surface of the heat shield proximate to the second end of the heat shield is brazed to an outer diameter surface of the seal wall proximate to the second end of the seal wall.

7. An outer air seal as recited in claim 1, wherein an inner diameter surface of the heat shield proximate to the first end of the heat shield is brazed to the outer diameter side of the side wall.

8. An outer air seal as recited in claim 1, wherein an outer diameter surface of the seal wall proximate to the first end of the seal wall is brazed to the inner diameter side of the side wall.

9. A turbine blade outer air sealing system for a gas turbine engine, comprising:

a cylindrical outer case with a forward end and an aft end; and a seal assembly radially inward of the cylindrical outer case, the seal assembly including a plurality of outer air seals arranged end to end circumferentially to form a cylinder, each outer air seal including:

a seal wall with a first end and a second end axially opposing the first end;

a heat shield radially outward of the seal wall with a first end and a second end axially opposing the first end, wherein the second end of the heat shield is joined to the second end of the seal wall;

a side wall disposed between the seal wall and the heat shield spacing the first end of the heat shield and the first end of the seal wall apart to form an inner cavity between the seal wall and the heat shield, wherein an inner diameter end of the side wall is joined to the first end of the seal wall and an outer diameter end of the side wall is joined to the first end of the heat shield, wherein the heat shield is configured to thermally isolate the cylindrical outer case from the inner cavity and the seal wall;

a blade seal disposed radially inward of the seal wall; and a plurality of shiplaps disposed radially outward of the heat shields, wherein each shiplap is configured to block air flow in the radial direction around a radial edge of a respective heat shield.

10. A turbine blade outer air sealing system as recited in claim 9, wherein each shiplap includes a bend configured to accommodate axial thermal expansion and contraction.

11. A turbine blade outer air sealing system as recited in claim 9, wherein a respective inner diameter surface of each shiplap is brazed onto a respective outer diameter surface of the heat shield.

12. A turbine blade outer air sealing system as recited in claim 9, wherein a respective gap separates each adjacent end of the outer air seals, wherein a plurality shiplaps are disposed radially outward of the heat shields and each respective shiplap is operatively connected to the adjacent ends of respective outer air seals proximate the respective gap, wherein each respective shiplap is configured to block air flow in the radial direction from flowing through the respective gap.

13. A turbine blade outer air sealing system as recited in claim 9, wherein the heat shield includes a bend configured to allow for axial thermal expansion and contraction.

14. A turbine blade outer air sealing system as recited in claim 9, further comprising braze joints between the second ends of the heat shield and the seal wall, between the first end of the heat shield and the outer diameter side of the side wall, and between the first end of the seal wall and the inner diameter side of the side wall, wherein the braze joints are configured to add circumferential stiffness to the blade seal helping to maintain the circular shape of the blade seal to control the clearance between a turbine blade tip and the blade seal.

15. A turbine blade outer air sealing system as recited in claim 9, wherein an inner diameter surface of the heat shield proximate to the second end of the heat shield is brazed to an outer diameter surface of the seal wall proximate to the second end of the seal wall.

16. A turbine blade outer air sealing system as recited in claim 9, wherein an inner diameter surface of the heat shield proximate to the first end of the heat shield is brazed to the outer diameter side of the side wall.

17. A turbine blade outer air sealing system as recited in claim 9, wherein an outer diameter surface of the seal wall proximate to the first end of the seal wall is brazed to the inner diameter side of the side wall.

18. A turbine blade outer air sealing system as recited in claim 9, further comprising a plurality of turbine blades disposed radially inward of the seal assembly, wherein the blade seal of each outer air seal is configured to reduce axial fluid leakage at the turbine blade tips.

* * * * *